US008308515B2

(12) United States Patent
Chang

(10) Patent No.: US 8,308,515 B2
(45) Date of Patent: Nov. 13, 2012

(54) MULTI-INTERFACES CONNECTOR

(76) Inventor: Nai-Chien Chang, New Taipei (TW)

( * ) Notice: Subject to any disclaimer, the term of this patent is extended or adjusted under 35 U.S.C. 154(b) by 77 days.

(21) Appl. No.: 13/093,019

(22) Filed: Apr. 25, 2011

(65) Prior Publication Data

US 2012/0003852 A1 Jan. 5, 2012

(30) Foreign Application Priority Data

Jul. 5, 2010 (TW) ..... 99212743 U

(51) Int. Cl.
*H01R 24/00* (2006.01)

(52) U.S. Cl. ..... 439/660; 439/76.1; 439/79

(58) Field of Classification Search ..... 439/660, 439/79, 76.1
See application file for complete search history.

(56) References Cited

U.S. PATENT DOCUMENTS 6,508,676 B1 * 1/2003 Xu ..... 439/660
6,832,934 B1 * 12/2004 Zhang ..... 439/660
7,726,983 B2 * 6/2010 Zhu ..... 439/79
2011/0009825 A1 * 1/2011 Chong et al. ..... 604/152
2011/0059655 A1 * 3/2011 Zhu ..... 439/660
2011/0065293 A1 * 3/2011 Zhu ..... 439/78
2011/0104909 A1 * 5/2011 Zhu ..... 439/55
2011/0104914 A1 * 5/2011 Zhu ..... 439/83
2011/0263162 A1 * 10/2011 Zhu ..... 439/660

* cited by examiner

*Primary Examiner* — Gary F. Paumen
(74) *Attorney, Agent, or Firm* — Chun-Ming Shih; HDLS IPR Services

(57) ABSTRACT

A multi-interfaces connector includes a plurality of housings, a circuit board and a casing. The circuit board has a soldering portion, and the circuit board has a plurality of tongue plates extended from one side of the soldering portion. The tongue plates are separately arranged through the plurality of housings. The tongue plates respectively have a plurality of first conductive pins, a plurality of second conductive pins and a plurality of third conductive pins. The casing has a hollow case body which includes a plurality of through holes. The plurality of housings are arranged with the circuit board and installed in the casing. Therefore, the multi-interfaces connector is capable of being inserted with several transmission lines which have different types of insertion plug.

16 Claims, 9 Drawing Sheets

MULTI-INTERFACES CONNECTOR

BACKGROUND OF THE INVENTION

1. Field of the Invention

The invention related to a connector, and in particular to a connector which has multi-interfaces with same type or different types.

2. Description of Prior Art

There are many connectors now arranged on electronic products to provide connection between the electronic products and external peripheral equipment, so as to transport data, video signal, audio signal, and so on.

The most popular connectors now, such as USB connector, display port connector, and HDMI connector, mainly include: a housing, a plurality of conductive pins, and a metal casing therein. The production of the traditional connectors may have the following steps: punching a metal sheet to produce the plurality of conductive pins; producing the plastic housing by injection molding; and, assembling the produced conductive pins and the plastic housing together. In other embodiment, the production of the traditional connectors can also follow the steps of: punching a metal sheet to produce the plurality of conductive pins; arranging the produced conductive pins into a mold which is used to produce the housing; and, producing the plastic housing with the plurality of conductive pins in the mold by injection molding. Therefore, one end of each of the plurality of conductive pins is fixed on a tongue plate of the housing, and the other end of each of the plurality of conductive pins extends out of the metal casing.

According to the embodiments mentioned above, if the housing and the plurality of conductive pins are produced separately, it is not so easy to assemble the conductive pins into the housing because the conductive pins are tiny and flexible. If the housing is produced with the plurality of conductive pins by injection molding, the compactness between the housing and the plurality of conductive pins may be a problem. For example, if the compactness is not good enough, an inserting plug of an external transmission line is not easy to contact internal pins of the connector when the inserting plug inserts into the connector. Therefore, the signal between the connector and the external transmission line can not be transported.

Internal space of traditional connectors mentioned above is limited, if an additional electronic element or electronic circuit is needed to add to the connector, then the connector needs to be re-designed. However, re-designing the connector to add the additional electronic element or electronic circuit may cause the connector volume bigger than that of the original connector, and the re-designed connector has no compatibility with other main board.

SUMMARY OF THE INVENTION

According to the disadvantages mentioned above, the present invention uses copper foil circuit of circuit board to replace traditional conductive pins of connector, wherein the copper foil circuit is produced by punching a metal sheet. In particularly, the circuit board can also allow the manufacture of additional electronic elements or electronic circuits thereon.

The present invention is to provide a multi-interfaces connector, wherein the connector includes a plurality of housings, a circuit board, and a casing. The plurality of housings includes a first housing, a second housing and a third housing, the first housing has a first perforation and a supporting plate extended from a front end face of the first housing, the second housing has a second perforation and two symmetrical supporting arms extended from a front end face of the second housing, and the third housing has a third perforation and two symmetrical clamping arms extended from a front end face of the third housing.

The circuit board has a soldering portion, and the circuit board has a first tongue plate, a second tongue plate, and a third tongue plate extended from one side of the soldering portion. The first tongue plate has a plurality of first conductive pins on one side face, each of the plurality of first conductive pins has a first soldering point at one end, and the plurality of first soldering points electrically connect to a plurality of first conductive terminals. The second tongue plate has a plurality of second conductive pins on both top face and bottom face, each of the plurality of conductive pins has a second soldering point at one end, and the plurality of soldering points electrically connect to a plurality of second conductive terminals. The third tongue plate has a plurality of third conductive pins on both top face and bottom face, each of the plurality of conductive pins has a third soldering point at one end, and the plurality of third soldering points electrically connect to a plurality of third conductive terminals.

The first tongue plate is arranged through the first perforation and fitted with the supporting plate of the first housing, the second tongue plate is arranged through the second perforation and placed on the supporting arms of the second housing, and the third tongue plate is arranged through the third perforation and clamped between the clamping arms of the third housing.

The casing has a hollow case body, the case body has a first through hole, a second through hole, and a third through hole on front end, and the case body has a folding plate on rear end, the plurality of housings and the circuit board are arranged in the casing. The first through hole, the second through hole, and the third through hole are capable of passing through by insertion plugs of different types of transmission lines to connect the insertion plugs with the first tongue plate, the second tongue plate, and the third tongue plate. The casing has an opening on bottom to provide the first conductive terminals, the second conductive terminals, and the third conductive terminals to expose externally. The casing also has a fixation pin on one side of the case body, and the connector can be fixed on a main board of an electrical device via the fixation pin.

BRIEF DESCRIPTION OF DRAWING

The features of the invention believed to be novel are set forth with particularity in the appended claims. The invention itself, however, may be best understood by reference to the following detailed description of the invention, which describes an exemplary embodiment of the invention, taken in conjunction with the accompanying drawings, in which:

DETAILED DESCRIPTION OF THE INVENTION

In cooperation with attached drawings, the technical contents and detailed description of the present invention are described thereinafter according to a preferable embodiment, being not used to limit its executing scope. Any equivalent variation and modification made according to appended claims is all covered by the claims claimed by the present invention.

Figure 1:
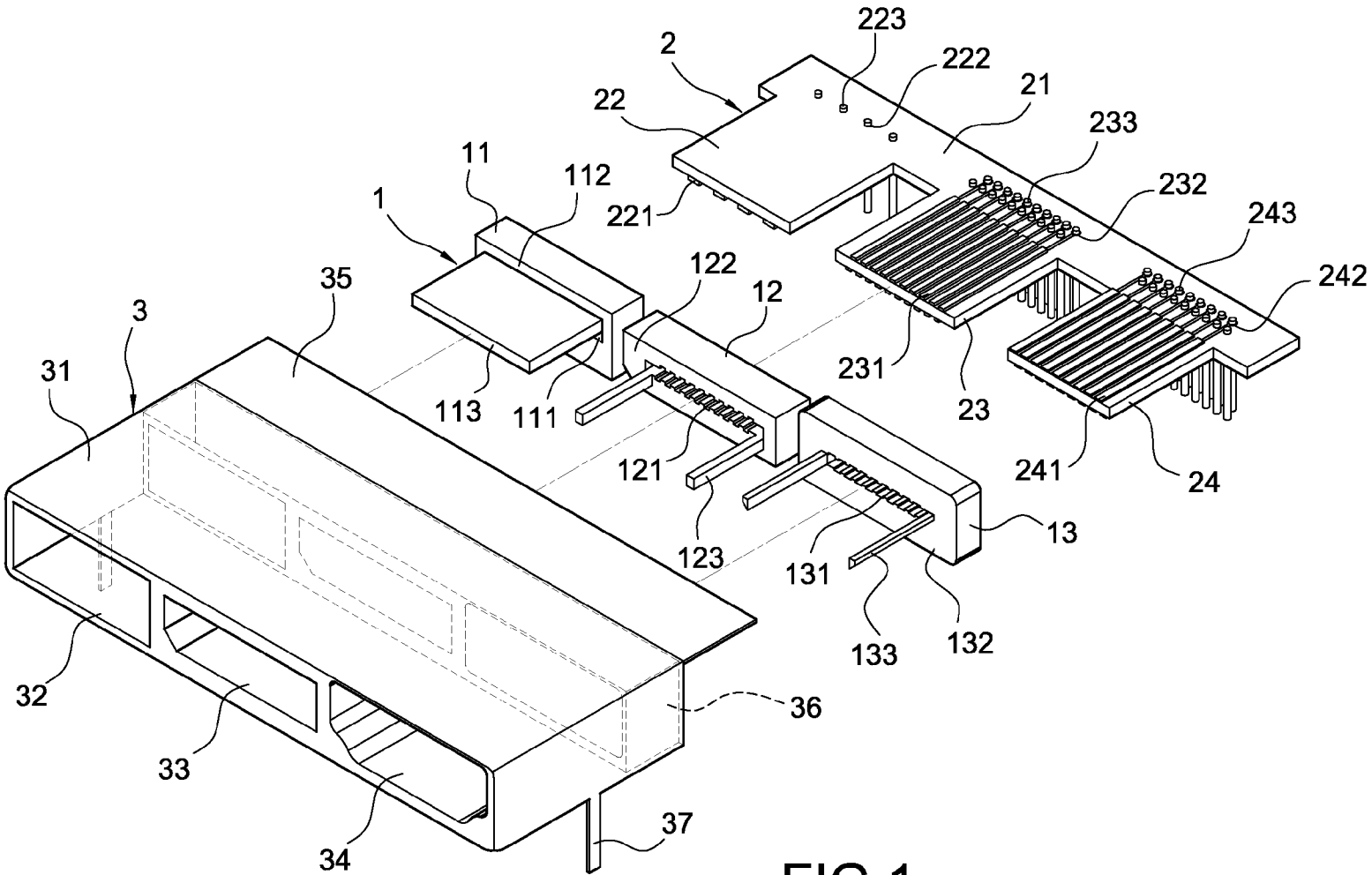
FIG. 1 is an exploded view of a multi-interfaces connector according to the present invention.
Figure 2:
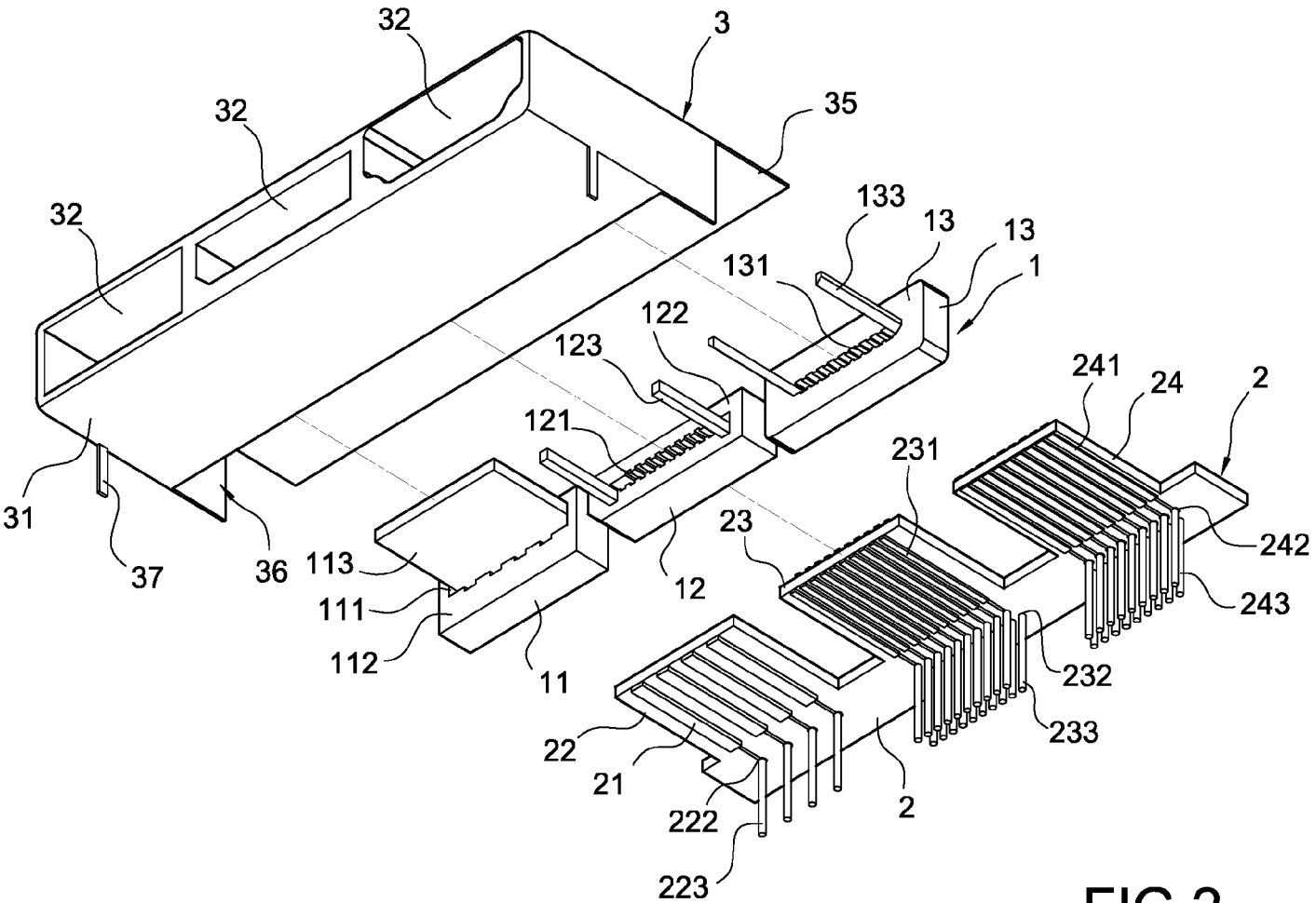
FIG. 2 is an exploded upward view of the multi-interfaces connector according to the present invention.
Figure 3:
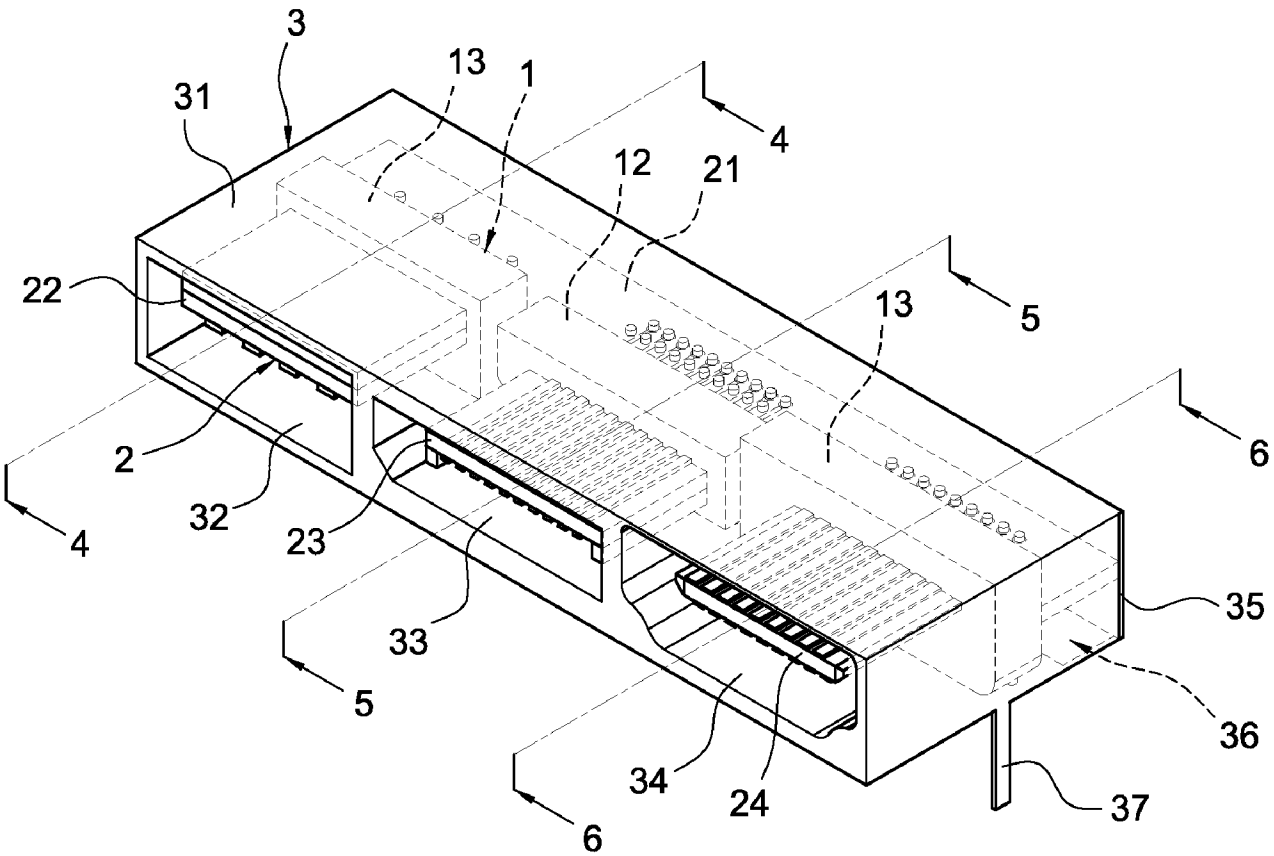
FIG. 3 is a perspective view of the multi-interfaces connector according to the present invention.
Figure 5:
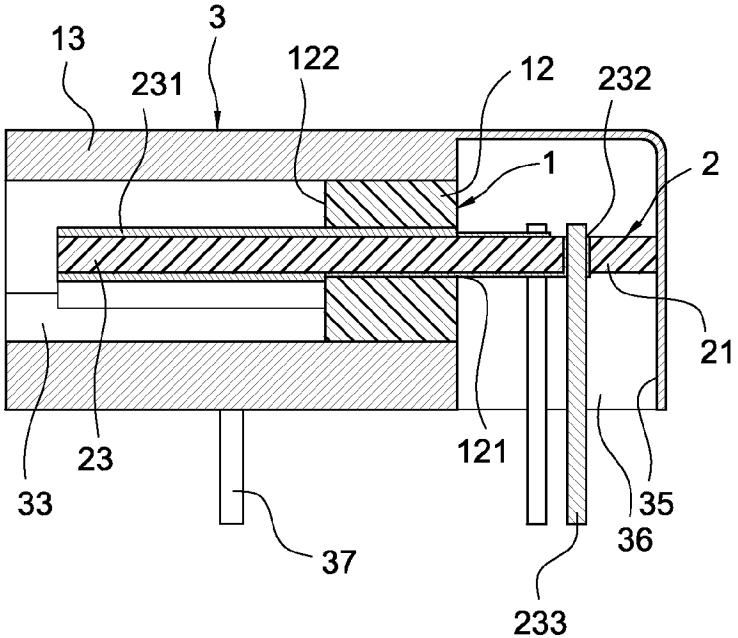
FIG. 5 is a section view taken along line 5-5 in FIG. 3.
Figure 4:
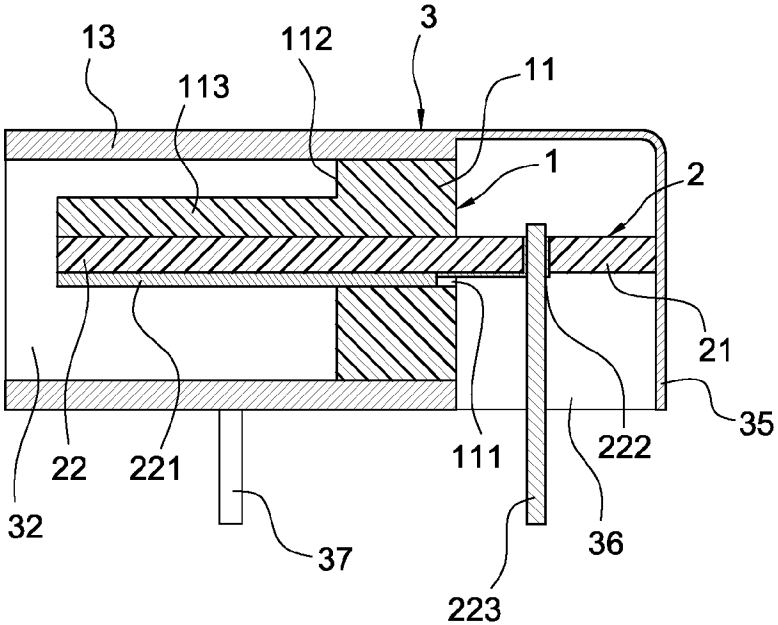
FIG. 4 is a section view taken along line 4-4 in FIG. 3.
Figure 6:
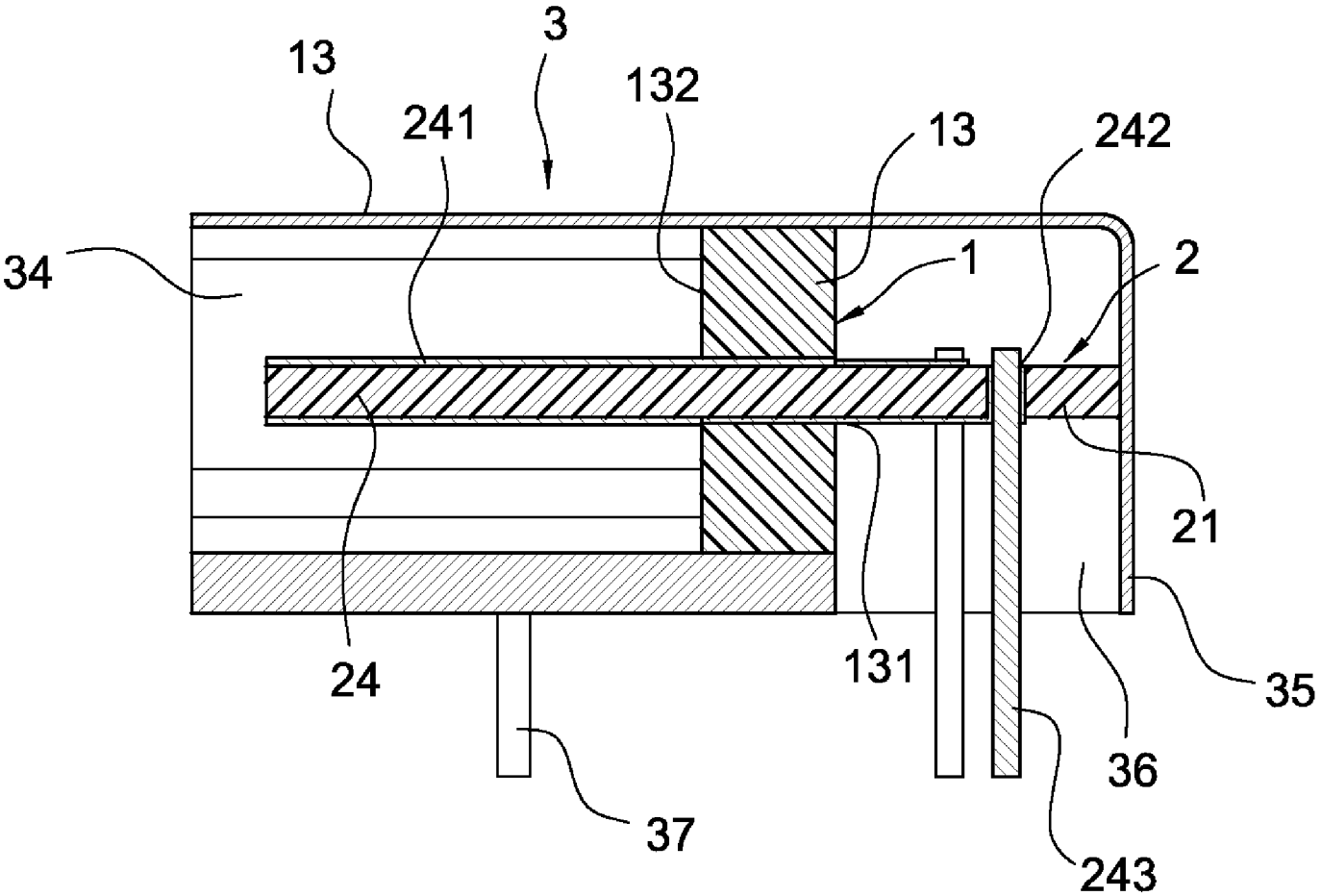
FIG. 6 is a section view taken along line 6-6 in FIG. 3.

FIG. 1 to FIG. 3 are exploded view, exploded upward view, and perspective view, respectively, of a multi-interfaces connector according to the present invention. FIG. 4 to FIG. 6 are section views taken along line 4-4, 5-5, 6-6 in FIG. 3, respectively. According to the Figures, the multi-interfaces connector in the present invention includes a plurality of housings 1, a circuit board 2 and a casing 3.

The plurality of housings 1 are consisted of insulating material, and the plurality of housings 1 include a first housing 11, a second housing 12, and a third housing 13. The first housing 11 has a first perforation 111 and a supporting plate 113 extended from a front end face 112 of the first housing 11. The second housing 12 has a second perforation 121 and two symmetrical supporting arms 123 extended from a front end face 122 of the second housing 12. The third housing 13 has a third perforation 131 and two symmetrical clamping arms 133 extended from a front end face 132 of the third housing 13.

The circuit board 2 has a soldering portion 211, and the circuit board 2 has a first tongue plate 22, a second tongue plate 23, and a third tongue plate 24 extended from one side of the soldering portion 21. The first tongue plate 22 has a plurality of first conductive pins 221 on one side face, each of the plurality of first conductive pins 221 has a first soldering point 222 at one end, and the plurality of first soldering points 222 electrically connect to a plurality of first conductive terminals 223.

The second tongue plate 23 has a plurality of second conductive pins 231 on both top face and bottom face, each of the plurality of the second conductive pins 231 has a second soldering point 232 at one end, and the plurality of second soldering points 232 electrically connect to a plurality of second conductive terminals 233. The third tongue plate 24 has a plurality of third conductive pins 241 on both top face and bottom face, each of the plurality of the third conductive pins 241 has a third soldering point 242 at one end, and the plurality of third soldering points 242 electrically connect to a plurality of third conductive terminals 243.

It should be mentioned is, the plurality of first conductive pins 221, second conductive pins 231, and third conductive pins 241 are gold fingers.

When the circuit board 2 is arranged with the first housing 11, the second housing 12, and the third housing 13, the first tongue plate 22 is arranged through the first perforation 111 and fitted with the supporting plate 113 of the first housing 11, the second tongue plate 23 is arranged through the second perforation 121 and placed on the supporting arms 123 of the second housing 12, and the third tongue plate 24 is arranged through the third perforation 131 and clamped between the clamping arms 133 of the third housing 13.

In this embodiment, the first tongue plate 22 is capable of inserting by an insertion plug of a USB transmission line, the second tongue plate 23 is capable of inserting by an insertion plug of a display port transmission line, and the third tongue plate 24 is capable of inserting by an insertion plug of a HDMI transmission line, but above examples are not intended to limit the protection scope of the present invention.

The casing 3 is consisted of metal material and has a hollow case body 31. The case body 31 has a first through hole 32, a second through hole 33, and a third through hole 34 on front end, and the case body 31 further has a folding plate 35 on rear end. The first through hole 32 is according to the first housing 11 and the first tongue plate 22, the second through hole 32 is according to the second housing 12 and the second tongue plate 23, and the third through hole 34 is according to the third housing 13 and the third tongue plate 24. The first through hole 32, the second through hole 33, and the third through hole 34 are capable of passing through by insertion plugs of different types of transmission lines (no shown) to connect the insertion plugs with the first tongue plate 22, the second tongue plate 23, and the third tongue plate 24. The plurality of housings 1 is arranged with the circuit board 2, and the plurality of housings 1 and the circuit board 2 can then be installed in the casing 3 after arranging together. The casing has an opening 36 on bottom to provide the first conductive terminals 223, the second conductive terminals 233, and the third conductive terminals 243 to expose externally.

Further, the casing 3 also has a fixation pin 37 on one side of the case body 31, the multi-interfaces connector in this embodiment can be fixed on a main board 51 of an electrical device 5 (shown in FIG. 7) via the fixation pin 37.

The plurality of housings 1 and the circuit board 2 are installed in the casing 3 when the plurality of housings 1 and the circuit board 2 are completely arranged together, and then, the folding plate 35 on the rear side of the casing 3 is bent to fix the plurality of housings 1 and the circuit board 2 in the casing 3. The first conductive terminals 223, the second conductive terminals 233, and the third conductive terminals 243 extends out of the casing 3 through the opening 36.

Figure 7:
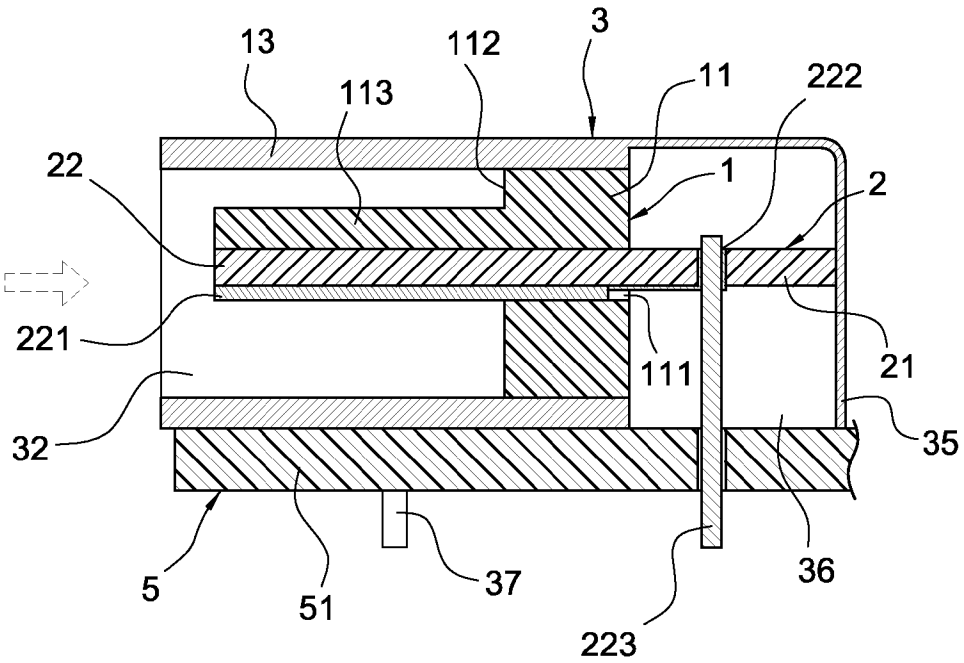
FIG. 7 is a first section view of the using status of the multi-interfaces connector according to the present invention.
Figure 7:
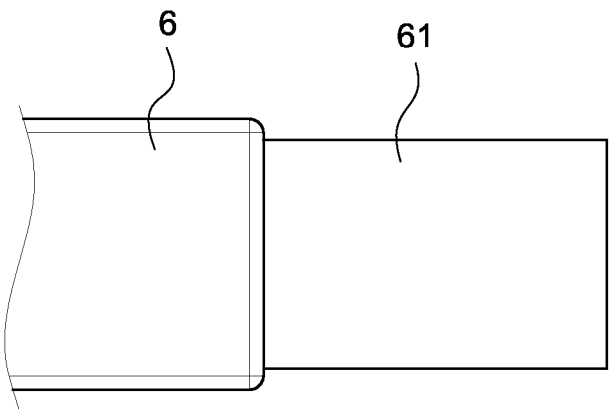
Figure 8:
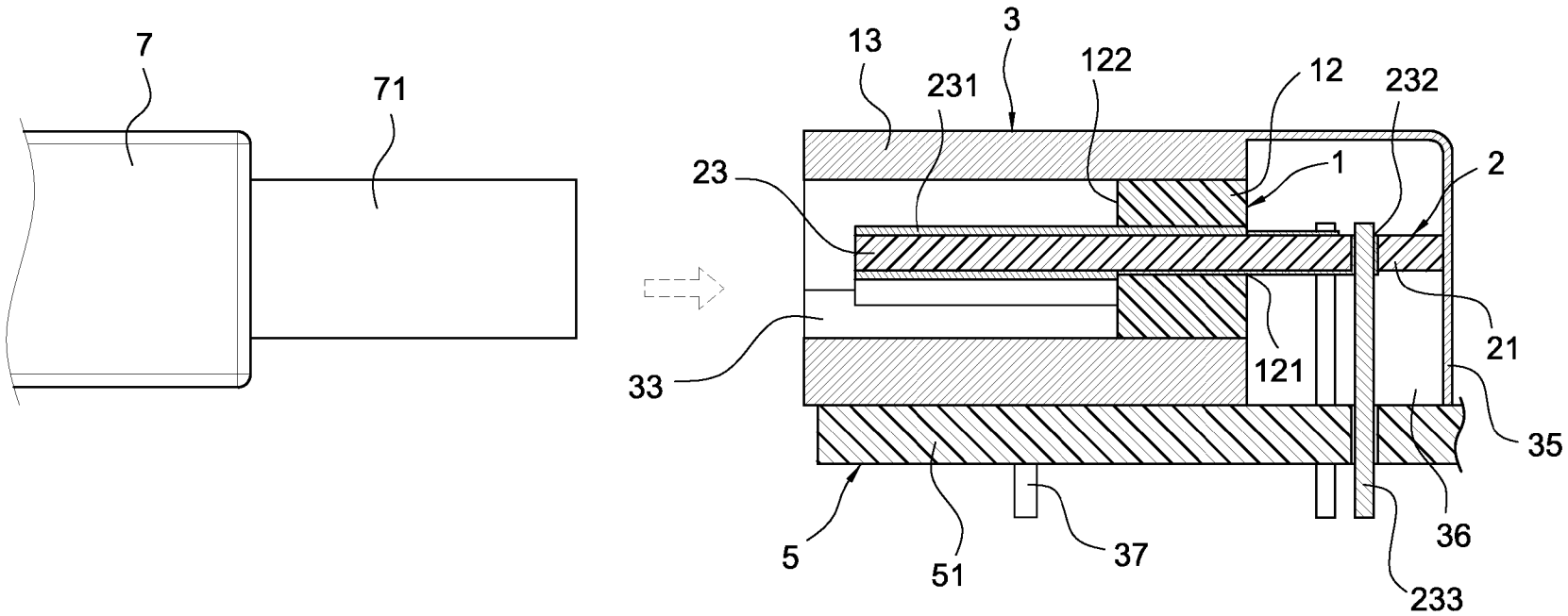
FIG. 8 is a second section view of the using status of the multi-interfaces connector according to the present invention.
Figure 9:
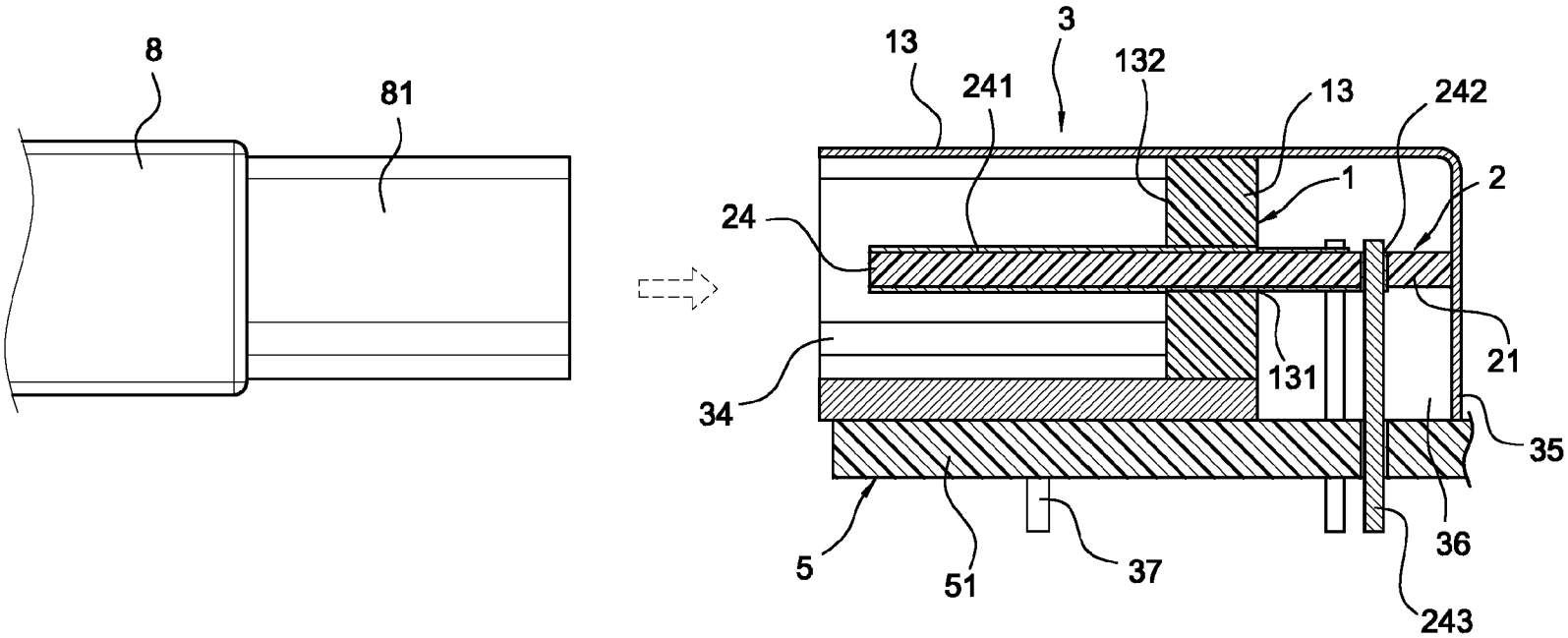
FIG. 9 is a third section view of the using status of the multi-interfaces connector according to the present invention.

FIG. 7 to FIG. 9 are first section view, second section view, and third section view according to the using status of the multi-interfaces connector of the present invention. When using the multi-interfaces connector in this embodiment, the first conductive terminals 223, the second conductive terminals 233, and the third conductive terminals 243 exposed out of the casing 3 are fixed and electrically connected to the main board 51 of the electrical device 5.

When the multi-interface connector electrically connects to the main board 51, three types of interface of the connector, for example, USB, Display port, and HDMI in this embodiment, are separately capable of inserting by insertion plugs 61, 71, and 81 of USB transmission line 6, Display port transmission line 7, and HDMI transmission line 8. Therefore, user can use the multi-interfaces connector to transmit data, video signal, and audio signal.

Figure 10:
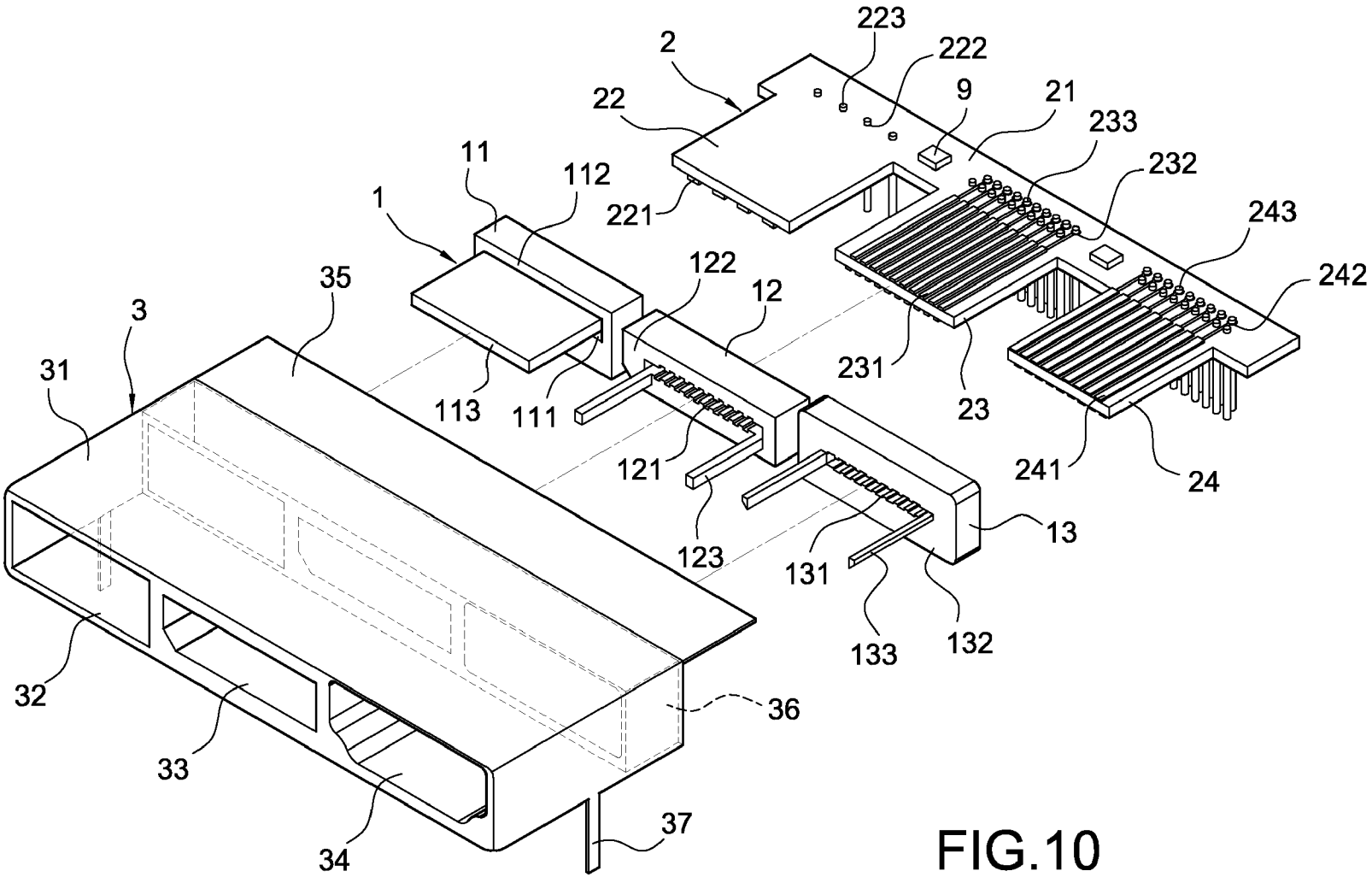
FIG. 10 is an exploded view of the multi-interfaces according to another embodiment of the present invention.

FIG. 10 is an exploded view according to another embodiment of the multi-interfaces of the present invention. The circuit board 2 in the invention applies copper foil to be conductive pins of connectors which apply different types of interface, and the multi-interfaces connector can add some electronic circuits 9 thereon, for example, EMI protection circuit, surge protection circuit, memory, control circuit, transmission circuit and receiving circuit, but not intended to limit the protection scope of the present invention. The electronic circuit 9 can be arranged directly to electrically connect to the circuit board 2 when producing the circuit board 2. Therefore the multi-interfaces connector needs not to add additional circuit boards thereon, and the production of the multi-interfaces connector in this embodiment is made easier.

It should be mentioned is, the interfaces of the multi-interfaces connector can be different interfaces such as a USB interface, a display port interface, and a HDMI interface in this embodiment of the present invention, but the interfaces of the multi-interfaces connector can also be all the same type in another embodiment, for example, three USB interfaces, three display port interfaces, or three HDMI interfaces on the multi-interfaces connector, not intended to limit the scope of the present invention.

Although the present invention has been described with reference to the foregoing preferred embodiments, it will be understood that the invention is not limited to the description thereof. Any equivalent variations and modifications can be made to those skilled in the art in view of the teaching of the present invention are also in the scope of the invention as defined in the appended claims.

What is claimed is:

1. A multi-interfaces connector comprising:

a plurality of housings including a first housing and a second housing, the first housing having a first perforation, and the second housing having a second perforation;

a circuit board having a soldering portion and a first tongue plate and a second tongue plate extended from one side of the soldering portion, the first tongue plate having a plurality of first conductive pins on one side face, each of the first conductive pins having a first soldering point at one end, and the plurality of first soldering points electrically connected to a plurality of first conductive terminals, the second tongue plate having a plurality of second conductive pins on both top face and bottom face thereof, each of the conductive pins having a second soldering point at one end, and the plurality of second soldering points electrically connected to a plurality of second conductive terminals; and a casing for encapsulating the plurality of housings and the circuit board, the casing having a hollow case body thereon, the case body having at least one first through hole corresponding to the first housing and the first tongue plate, and the case body having at least one second through hole corresponding to the second housing and the second tongue plate.

2. The multi-interfaces connector of claim 1, wherein the plurality of housings are made of insulating material.

3. The multi-interfaces connector of claim 2, wherein the first housing has a supporting plate extended from a front end face of the first housing, the first tongue plate is arranged through the first perforation and fitted with the supporting plate.

4. The multi-interfaces connector of claim 2, wherein the second housing has two symmetrical supporting arms extended from a front end face of the second housing, the second tongue plate is arranged through the second perforation and placed on the supporting arms.

5. The multi-interface connector of claim 2, wherein the first tongue plate is used for insertion of an insertion plug of a USB transmission line.

6. The multi-interface connector of claim 1, wherein the second tongue plate is used for insertion of an insertion plug of a display port transmission line.

7. The multi-interface connector of claim 1, wherein the first conductive pins and the second conductive pins are gold fingers.

8. The multi-interface connector of claim 1, wherein the plurality of housings further includes a third housing, and the third housing has a third perforation and two symmetrical clamping arms extended from a front end face of the third housing.

9. The multi-interface connector in claim 8, wherein the circuit board further includes a third tongue plate extended from one side of the soldering portion thereon, the third tongue plate has a plurality of third conductive pins on both top face and bottom face, each of the plurality of conductive pins has a third soldering point at one end, the plurality of third soldering points electrically connect to a plurality of third conductive terminals, and the third tongue plate is arranged through the third perforation and clamped between the clamping arms of the third housing.

10. The multi-interfaces connector of claim 9, wherein the third tongue plate is used for insertion of an inserting plug of a HDMI transmission line.

11. The multi-interfaces connector of claim 10, wherein the casing further includes a third through hole which is corresponding to the third housing and the third tongue plate.

12. The multi-interfaces connector of claim 11, wherein the casing is made of metal material.

13. The multi-interfaces connector of claim 12, wherein the case body has a folding plate on rear end of the case body, and has an opening on bottom of the case body.

14. The multi-interface connector of claim 13, wherein the case body has a fixation pin on one side of the case body.

15. The multi-interfaces connector of claim 1, wherein the circuit board further includes an electronic circuit thereon.

16. The multi-interfaces connector of claim 15, wherein the electronic circuit is selected from the group consisting of EMI protection circuit, surge protection circuit, memory, control circuit, transmission circuit and receiving circuit.

* * * * *